United States Patent [19]

Sugita et al.

[11] Patent Number: 4,706,430

[45] Date of Patent: Nov. 17, 1987

[54] CONCRETE REINFORCING UNIT

[75] Inventors: Minoru Sugita; Teruyuki Nakatsuji; Tadashi Fujisaki, all of Tokyo; Hisao Hiraga, Yokohama; Takashi Nishimoto; Minoru Futagawa, both of Sagamihara, all of Japan

[73] Assignees: Shimizu Construction Co., Ltd., Tokyo; Dainihon Glass Industry Co., Ltd., Sagamihara, both of Japan

[21] Appl. No.: 894,832

[22] Filed: Aug. 8, 1986

[30] Foreign Application Priority Data

Dec. 26, 1985 [JP] Japan ..... 60-295751
Feb. 26, 1986 [JP] Japan ..... 61-41197

[51] Int. Cl.[4] ..... E04F 15/10; B32B 3/10; F16B 2/14

[52] U.S. Cl. ..... 52/309.16; 52/309.17; 52/655; 52/664; 428/109; 428/110; 428/292; 428/703

[58] Field of Search ..... 52/309.16, 309.17, 655, 52/664; 428/110, 109, 292, 703

[56] References Cited

U.S. PATENT DOCUMENTS

| | | | |
|---|---|---|---|
| 3,298,152 | 1/1967 | Lockshaw | 52/655 X |
| 3,685,862 | 8/1972 | Rudolf | 52/655 |
| 3,704,561 | 12/1972 | Meyer | 52/309.16 X |
| 3,851,786 | 12/1974 | Kaemper | 52/309.16 X |
| 4,276,337 | 6/1981 | Coonrod | 52/309.16 X |
| 4,578,301 | 3/1986 | Currie et al. | 428/110 X |

*Primary Examiner*—Alfred C. Perham
*Attorney, Agent, or Firm*—Oblon, Fisher, Spivak, McClelland & Maier

[57] ABSTRACT

A concrete reinforcing unit adapted to be embedded in the concrete for concrete construction. The concrete reinforcing unit includes: first parallel textile elements; second parallel textile elements crossing the first parallel textile elements at first crossing portions, each of the first textile elements and the second textile elements including at least one row of first textiles and a first resin matrix, made of a first resin, for bonding the first textiles; and an attaching mechanism for attaching the first reinforcing elements and the second reinforcing elements at corresponding first crossing portions to form a grid member having opposite ends.

18 Claims, 23 Drawing Figures

CONCRETE REINFORCING UNIT

FIELD OF THE INVENTION

The present invention relates to a concrete reinforcing unit which is suitably used as a replacement of the reinforcing steel in various concrete constructions.

BACKGROUND OF THE INVENTION

For example, girders and columns of a building have concrete reinforcements embedded in concrete, including steel frameworks having main reinforcements wound with additional reinforcements for shearing such as hoops, stirrups and spiral hoops.

These steel reinforcements are widely used for various concrete constructions since their cost is relatively small and they have sufficient strength. With recent progress in architecture and civil engineering, there are, however, the following problems to be solved:

(1) It is difficult to provide large-sized reinforcing units since they are poor in transportability and workability on the construction site due to their considerable weight;

(2) Binding, welding and pressure welding of steel reinforcements are rather laborious and thus take a considerable part of the cohstruction period for concrete construction;

(3) It is very hard to enhance accuracy in assembling steel reinforcements since the bending of large diameter reinforcement bars is difficult on the construction site;

(4) Steel reinforcements necessitate control for preventing corrosion during storage and are further liable to cause breaking away of the concrete due to corrosion thereof; and (5) Considerable differences in the covering depth of concrete between the main reinforcements and reinforcements for shearing occur in columns and girders of concrete construction such as a building, since main reinforcements and reinforcements for shearing are embedded in the concrete in a crosswise manner to form different levels between them.

OBJECTS OF THE INVENTION

Accordingly, it is an object of the present invention to provide a concrete reinforcing unit which is much smaller in weight than the prior art concrete reinforcement and is prefabricated in an integral form, thus having excellent workability and transportability and enabling production of relatively large-sized reinforcement units with high accuracy.

It is another object of the present invention to provide a concrete reinforcing unit which is excellent in corrosion resistance and is hence useful for concrete construction.

SUMMARY OF THE INVENTION

With these and other objects in view the present invention provides a concrete reinforcing unit adapted to be embedded in the concrete for concrete construction, comprising: first parallel reinforcement elements; second parallel reinforcement elements crossing said first reinforcement elements at first crossing portions, each of the first and second reinforcement elements including at least one row of first textiles and a first resin matrix, made of a first resin, for bonding the first textiles thereof; and attaching means for attaching said first reinforcing elements and said second reinforcing elements at corresponding first crossing portions to form a grid member having a peripheral portion.

Preferably, the attaching means may be the first resin, the first and the second reinforcing elements being impregnated with the first resin before attachment thereof. With such a construction, the concrete reinforcing unit may have the first and the second reinforcement elements placed substantially at an equal level around the first crossing portions and thus substantially uniform covering depth of the concrete may be achieved for the concrete construction.

In another preferred form, at least one of the first reinforcing elements and the second reinforcing elements may each comprise a plurality of textile rows. The textile rows of both a corresponding first reinforcing element and a corresponding second reinforcing element are alternatively stacked at the first crossing portion. The first reinforcing elements and the second reinforcing elements are bonded with the first resin at the first crossing portions. Such a structure provides the concrete reinforcing unit with excellent strength as well as a substantially equal level around the first crossing portions.

In another modified form, the first reinforcing elements and the second reinforcing elements may have a substantially rectangular cross-section.

In practice, the grid member may be substantially two-dimensional and be embedded in the concrete so that it is parallel with a surface of the concrete.

Further, the grid member may be used in the number of at least two, and adjacent grid members may be disposed to overlap each other at peripheral portions thereof.

Preferably, the first textiles are each formed into at least one structure of a tow, roving, strand, yarn, thread, sennit and braid, and are made of at least one fiber selected from the group consisting of a glass fiber, carbon fiber, aramid fiber, boron fiber, ceramic fiber, and metallic fiber.

The first resin matrixes are preferably made of a substance selected from the group consisting of an epoxy resin, unsaturated polyester resin, vinyl ester resin, polyurethane resin, diallylphthalate resin, phenolic plastic, polyacetal, saturated polyester resin, polyamide resin, polystyrene resin, polycarbonate resin, polyvinyl chloride resin, polyethylene resin, polypropylene resin and acrylic resin.

Preferably, the first reinforcing elements and the second reinforcing elements each contain about 10 to about 90% by volume of the first textiles and about 90 to about 10% by volume of the first resin.

In another preferred form, the first reinforcing elements and the second reinforcing elements each contain about 30 to about 70% by volume of a glass fiber and about 70 to about 30% by volume of a vinyl ester resin.

In still another preferred form, the first reinforcing elements and the second reinforcing elements each contain about 20 to 60% by volume of a carbon fiber and about 80 to about 40% by volume of a vinyl ester resin.

Preferably, the concrete reinforcing unit may further comprise: at least three longitudinal parallel reinforcing elements disposed in a three-dimensional manner; and second attaching means for attaching said longitudinal parallel reinforcing elements to the first reinforcing elements and the second reinforcing elements, and wherein the first reinforcing elements and second reinforcing elements cross corresponding longitudinal reinforcing elements at second crossing portions and are attached to the corresponding longitudinal reinforcements at second crossing portions with the second attaching means. Such a construction provides three-dimensional concrete reinforcing unit having an excellent workability, transportability and a relatively large size as compared to the prior art concrete reinforcement. Further, such a concrete reinforcing unit is excellent for corrosion resistance and is hence useful in concrete construction.

In a further preferred form, the longitudinal reinforcing elements may each comprise: at least one row of second parallel textiles; and a second resin matrix, made of a second resin, for integrally bonding said row of the second textiles. The textile rows of each of a corresponding first reinforcing element, a corresponding second reinforcing element and a corresponding longitudinal reinforcing element may be alternately stacked at each of said second crossing portions. The second attaching means may be one of the first resin and the second resin. With such a construction, the concrete reinforcing unit may have the first reinforcement elements, the second reinforcement elements and the longitudinal reinforcement elements placed substantially at an equal level around the second crossing portions. Thus, substantially uniform concrete covering depth may be achieved for concrete construction.

Further, the first reinforcing elements and the second reinforcing elements preferably extend between two adjacent longitudinal reinforcing elements so that the first reinforcing elements and the second reinforcing elements each generally define a spiral in the overall shape thereof.

The second textiles may be each formed into at least one structure of a tow, roving, strand, yarn, thread, sennit and braid, and wherein the second textiles are each made of at least one fiber selected from the group consisting of a glass fiber, carbon fiber, aramid fiber, boron fiber, ceramic fiber, and metallic fiber. Further, the second resin matrixes may each be made of a substance selected from the group consisting of an epoxy resin, unsaturated polyester resin, vinyl ester resin, polyurethane resin, diallylphthalate resin, phenolic plastic, polyacetal, saturated polyester resin, polyamide resin, polystyrene resin, polycarbonate resin. polyvinyl chloride resin, polyethylene resin, polypropylene resin and acrylic resin.

The longitudinal reinforcing elements may each contain about 10 to about 90% by volume of the second textiles and about 90 to about 10% by volume of the second resin. Preferably, the longitudinal reinforcing elements each contain about 30 to about 70% by volume of a glass fiber and about 70 to about 30% by volume of a vinyl ester resin. In another preferred form, the longitudinal reinforcing elements each contain about 20 to 60% by volume of a carbon fiber and about 80 to about 40% by volume of a vinyl ester resin.

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
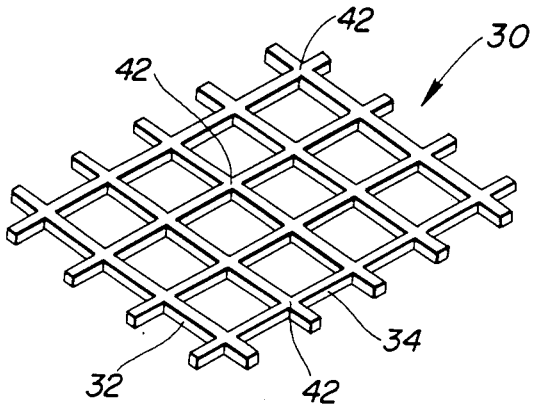
FIG. 1 is a perspective view of a concrete reinforcing unit according to the present invention.
Figure 2:
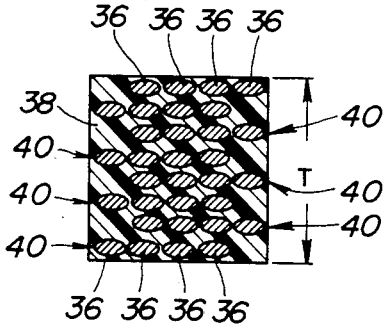
FIG. 2 is an enlarged cross-section of each of the first reinforcing elements and the second reinforcing elements in FIG. 1.
Figure 3:
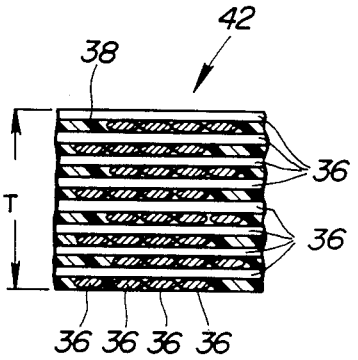
FIG. 3 is an enlarged cross-section of a crossing portion in FIG. 1.

FIGS. 1 to 3 illustrate a concrete reinforcing unit 30 in the shape of a grid according to the present invention. The reinforcing unit 30 is suitably used as a reinforcement which is embedded in concrete to form a wall or a floor of a building. The reinforcing unit 30 includes a plurality of first parallel reinforcing elements 32 and a plurality of second parallel reinforcing elements 34 crossing the first parallel reinforcing elements to form a grid, all the first and second reinforcing elements 32 and 34 being disposed in a plane. In this embodiment, the number of the first reinforcing elements 32 is five and the number of the second reinforcing elements 34 is four. As illustrated in FIG. 2, each of the first and second reinforcing elements 32 and 34 includes eight vertically stacked rows of textiles 36 which are bonded together through a resin matrix 38. Each textile row 40 has four parallel textiles 36, rovings in this embodiment, contacting or nearly contacting adjacent textile or textiles 36 of the same row 40. Crossing portions 42 of both the first and second reinforcing elements 32 and 34 is illustrated in a sectional view in FIG. 3, in which eight textile rows 40 of the first reinforcing elements 32 and eight textile rows 40 of the second reinforcing elements 34 are alternatively stacked, so that the crossing portion 42 has 16 rows of textiles in total in this embodiment. However, the number of textile rows 40 in each crossing portion 42 may be two or more. Each crossing portion 42 and non-crossing portions of the first and second reinforcing elements 32 and 34 are substantially equal in thickness T, and hence, the upper and lower faces of the reinforcing unit 30 are each at an equal level. The upper and lower faces of the reinforcing unit 30 may be roughened for enhancing adhesive strength to the resin of the resin matrix 38.

In the present invention, the structure of the textiles 36 include, for example, a tow, roving, strand, yarn, thread and braiding.

Textiles 36 are, according to the present invention, made of: for example, a glass fiber; carbon fiber; aramid fiber; boron fiber; ceramic fiber such as made of alumina, silica and titanium oxide; metallic fiber such as stainless steel fiber; and combination thereof. Preferably, glass fiber and carbon fiber are used due to relatively light weight and high strength.

The resin matrix 38 which bonds textile rows 40 together is, according to the present invention, preferably made of a vinyl ester resin due to its excellent adhesiveness to textiles 36 and sufficient strength but the resin forming the resin matrix 38 depends on the kind of textiles used. Use may be made of other synthetic resins such as an epoxy resin, unsaturated polyester resin, polyurethane resin, diallylphthalate resin, phenolic plastic, polyacetal, saturated polystyrene resin, polyamide resin, polystyrene resin, polycarbonate resin, polyvinyl chloride resin, polyethylene resin, polypropylene resin and acrylic resin.

The reinforcing unit 30, according to the present invention, generally contains about 10 to about 90% by volume of the textile 36 but the ratio is selected in view of the kind and strength of the textiles 36 and use of the reinforcing unit. When a glass fiber is used for the textiles 36 and a vinyl ester resin is used for the resin matrix 38, the reinforcing unit 30 for building constructions includes preferably about 30 to about 70% by volume of the glass fiber. Below about 30%, strength of the resultant reinforcing unit reduces and beyond about 70%, the resulting reinforcing unit is costly in the glass fiber. When a pitch carbon fiber and a vinyl ester resin are used, the reinforcing unit includes preferably about 20 to about 60% by volume of the pitch carbon fiber. Below about 20% by volume of the pitch carbon fiber, the resulting reinforcing unit is rather inferior in strength, and above about 60%, cost performance of the carbon fiber is considerably reduced although the reinforcing unit has relatively high strength.

Figure 4:
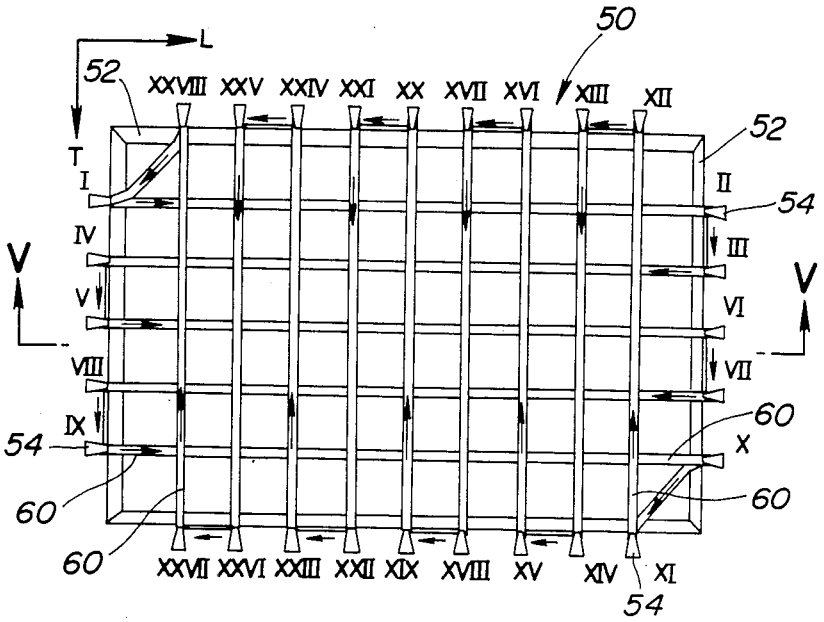
FIG. 4 is a plan view of an apparatus for fabricating the concrete reinforcing unit in FIG. 1, with the first and the second reinforcing elements set in it.
Figure 5:
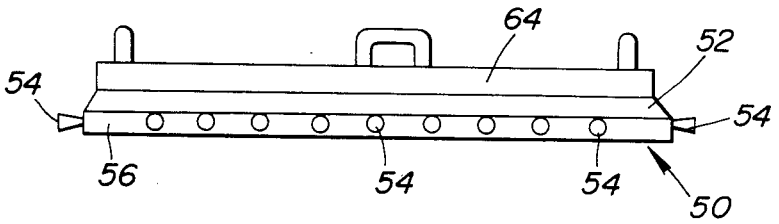
FIG. 5 is a side view of the apparatus in FIG. 4 with a depressing plate placed in position.

The reinforcing unit 30, according to the present invention, may be produced by means of an apparatus as illustrated in FIGS. 4 and 5, although in this apparatus a grid reinforcing unit having five first reinforcing elements 32 and nine second reinforcing elements 34 is to be fabricated. In FIGS. 4 and 5, the reference numeral 50 designates a rectangular base plate having chamfered upper edges 52. Taper pins 54 are mounted in the number of 28 at their smaller diameter ends to lateral faces 56 of the base plate 50 so that they are located to correspond to pitches of the first and second reinforcing elements 32 and 34.

Figure 6:
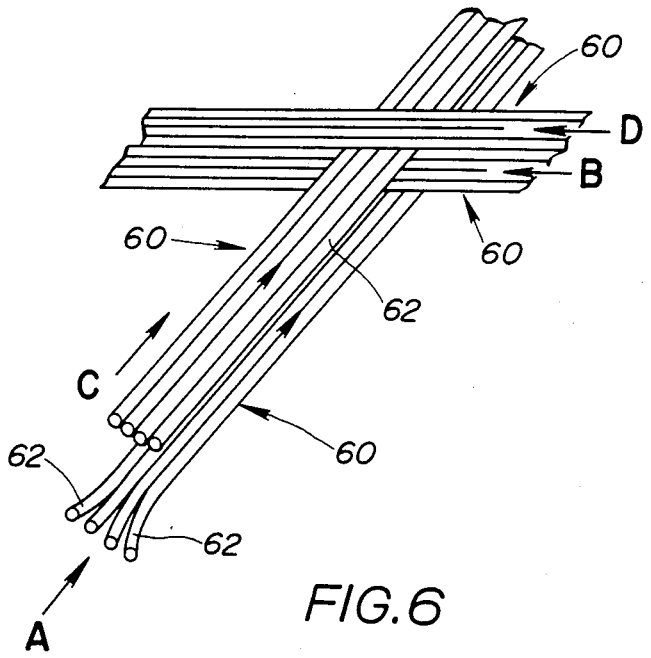
FIG. 6 is an illustrative view demonstrating how to interweave resin-impregnated textile rows to produce the concrete reinforcing unit in FIG. 1.
Figure 7:
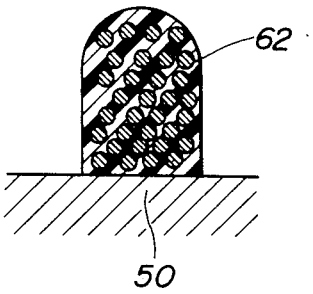
FIG. 7 is an enlarged cross-sectional view of one of the resin-impregnated textile bundles before it is depressed with the depressing plate in FIG. 5.
Figure 8:
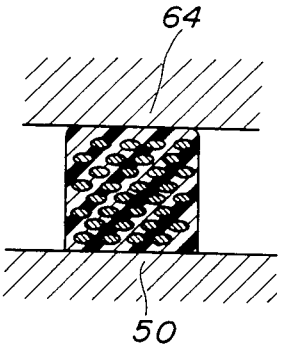
FIG. 8 is an enlarged cross-sectional view of the depressed textile bundle in FIG. 7.

In producing the reinforcing unit 30, a row 60 of continuous textiles 62, which are impregnated with a resin for forming the resin matrix 38, are hooked around each pin 54 to extend it tightly between facing pins 54, for example, in a longitudinal direction L and then in a transverse direction T in the order I–XXVIII as shown in FIG. 4. When a grid member having more than two textile rows 40 is made as in this embodiment, the row of the continuous textiles 62 is returned from the pin XXVIII to the pin I and then the operation described above is repeated. Adjacent textile rows 60 and 60 at crossing portions 42 cross each other. That is, textile rows example 1 of the first and second reinforcing elements 32 and 34 are alternatively stacked at the crossing portions 42. FIG. 6 illustrates one crossing portion 42 of four rows 60 of textiles 62 impregnated with a resin, each textile row 60 including four textiles 62, rovings in this embodiment. The four textile rows 60 are stacked in the alphabetical order A–D as illustrated. Thus, in the reinforcing unit 30 in FIGS. 1 to 3, the above-stated operation which consists of four steps A to D is repeated four times since each crossing portion 42 thereof includes 16 rows vertically stacked. In this process sufficient tension must be applied to the textiles 62 to keep them tight. This process is manually carried out, but may be achieved automatically by means of a numerically controlled machine which is actuated on a predetermined program describing a two-dimensional pattern of the grid member 30. Then, the grid member thus formed (FIG. 7) is depressed by means of a depressing plate 64 as shown in FIG. 8 for providing a uniform thickness to it. When the resin is set, each of the first and the second reinforcing elements 32 and 34 is cut at their opposite ends near the pins 54 and then removed from the base plate 50. Thus, the grid member 30 is completed. It is to be noted that the base plate and the depressing plate should have poor adhesive properties to the resin. In this embodiment, the working faces of the base plate 50 and the depressing plate 64 are coated with Teflon resin, and the pins 54 are applied with a wax for this purpose.

Rough surfaces may be formed in the upper or lower faces of the reinforcing unit by providing irregularity to the lower face of the depressing unit or the upper face of the base plate. The rough faces of the reinforcing unit enhance its adhesive property to the concrete in which it is embedded.

Although two adjacent first reinforcing elements 32 and 32 and two adjacent second reinforcing elements 34 and 34 define a square pattern, they may form a diaper pattern. The grid member 30 may have bias reinforcing elements crossing both the first and second reinforcing elements 32 and 34. In this case, a reinforcing unit having a hexagonal pattern may be formed. In this embodiment, the grid member 30 has a constant pitch, but a portion of the grid member 30 may have a pitch larger than the other portion, in which case a rectangular pattern may be defined.

For producing a grid reinforcing unit, a plurality of separate first and second reinforcing elements previously set may be attached. In this case, the separate first and second reinforcing elements are bound with strings or fastened with bolts and nuts at the crossing portions. Alternatively, they may be bonded or attached by melting.

Figure 9:
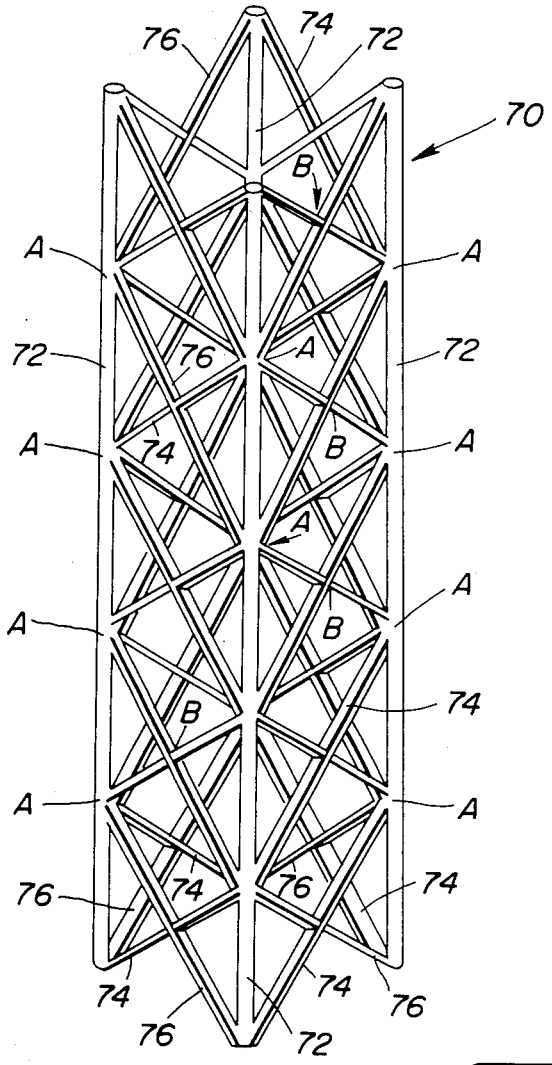
FIG. 9 is a perspective view of a concrete reinforcing unit having a lattice girder structure according to the present invention.
Figure 11:
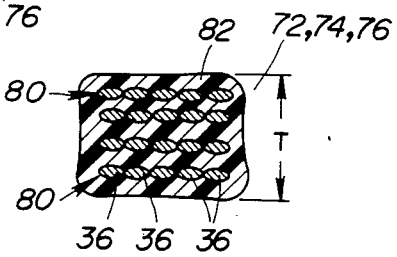
FIG. 11 is an enlarged cross-section of each of the spiral reinforcing elements and the longitudinal reinforcing elements.
Figure 10:
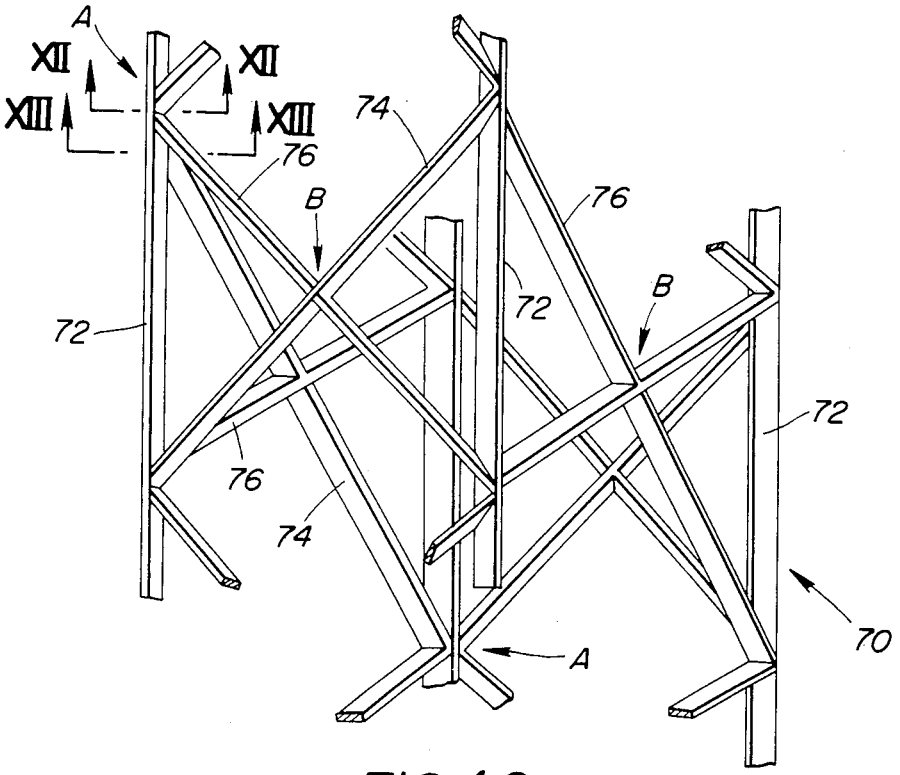
FIG. 10 is an enlarged partial view of the concrete reinforcing unit in FIG. 9.
Figure 13:
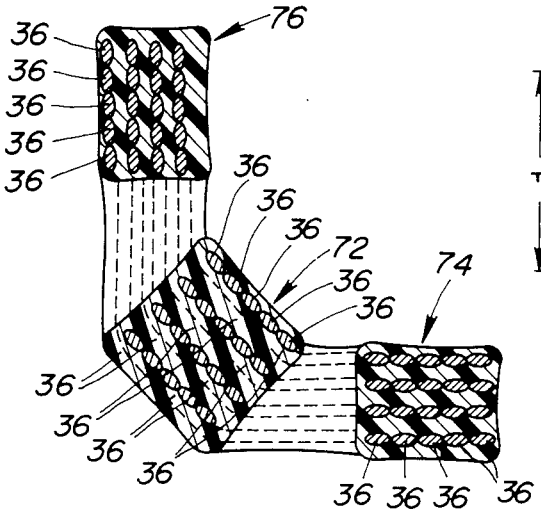
FIG. 13 is an enlarged cross-section taken along the line XIII—XIII in FIG. 10.

FIGS. 9 and 10 illustrate another concrete reinforcement unit 70 having a lattice girder structure according to the present invention. The reinforcement unit 70 is used as a reinforcement for a column or a beam of a concrete building. The reinforcement unit 70 includes four parallel longitudinal reinforcing elements 72, four first spiral reinforcing elements 74 as lattice bars and four second spiral reinforcing elements 76 as the other lattice bars. The longitudinal reinforcing elements 72 are disposed in a three-dimensional manner with an equal spacing. The first spiral reinforcing elements 74 and the second spiral reinforcing elements 76 spirally extend around the four longitudinal reinforcing elements 72 in opposite directions, thus forming crossing portions A on longitudinal reinforcing elements 72 and crossing portions B between adjacent two longitudinal reinforcing elements 72 and 72. As illustrated in FIG. 11, each of the longitudinal reinforcing elements 72 and the spiral reinforcing elements 74, 76 has a structure similar to the structure, as shown in FIG. 2, of the reinforcing elements 32 and 34 of the grid member 30, but it includes four textile rows 80, and each row consists of five textiles 36. The textiles of these elements 72, 74 and 76 may be the same in their material and structure as the textiles of the grid member 30 and are contained in a resin matrix 82 which may also be made of the same material as the resin matrix 38 of the preceding embodiment. In this embodiment, the textiles 36 of each of the longitudinal reinforcing elements 72 and the first and second spiral reinforcing elements 74 and 76 are integrally bonded by the resin matrix 82 of the same resin. The longitudinal reinforcing elements and the first and second spiral reinforcing elements are substantially equal in the ratio of the textiles over the resin to those of the first embodiments.

Figure 12:
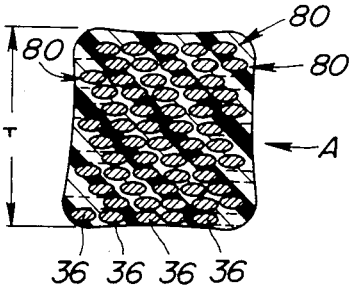
FIG. 12 is an enlarged cross-section taken along the line XII—XII in FIG. 10.

In each of the crossing portions A, textile rows 80 of a corresponding longitudinal reinforcing element 72 and corresponding first and second spiral reinforcing elements 74 and 76 are, as illustrated in FIG. 12, alternatively stacked to form at least three stacked rows, twelve rows in this embodiment. Each of the crossing portions B have textile rows 80 of the first and the second spiral reinforcing elements 74 and 76 alternately stacked in the same manner as the crossing portions 42 of the reinforcing elements 32 and 34 of the grid member shown in FIG. 3, but in this embodiment the total number of the textile rows 80 stacked is eight with each row including five textiles 36. Thickness T of each of the longitudinal reinforcing elements 72 and the first and second spiral reinforcing elements 74 and 76 is substantially equal.

Figure 14:
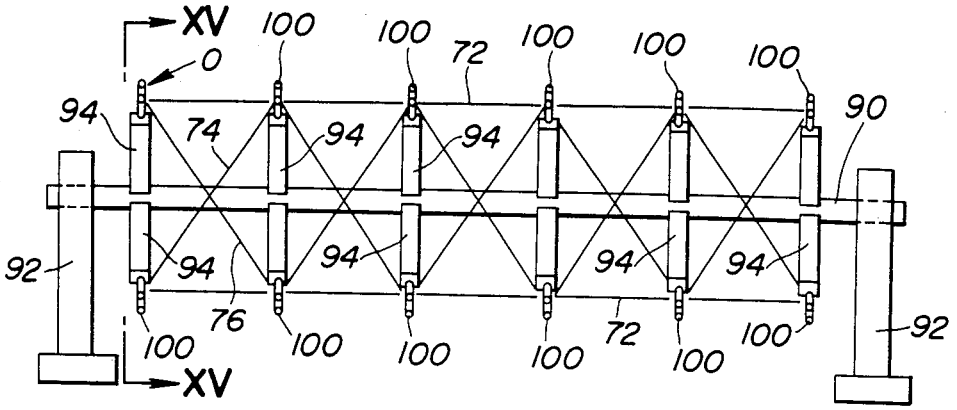
FIG. 14 is a front view of an apparatus for fabricating the concrete reinforcing unit in FIG. 9.
Figure 15:
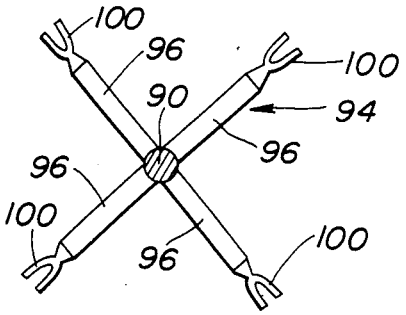
FIG. 15 is an enlarged view taken along the line XV—XV in FIG. 14.
Figure 17:
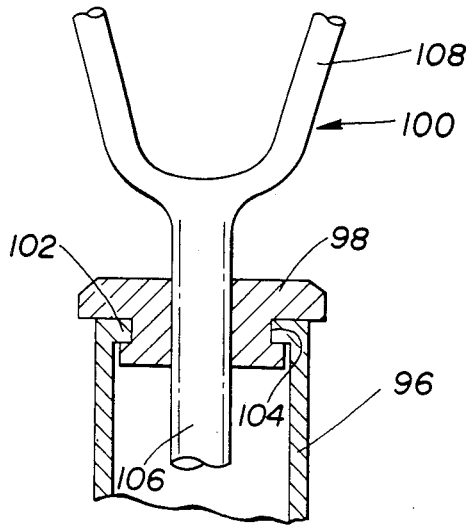
FIG. 17 is an enlarged view, partly in axial section, of the hooking portion of the apparatus in FIG. 14.

The concrete reinforcing unit 70 is fabricated by means of an apparatus illustrated in FIGS. 14 and 15, in which the reference numeral 90 designates a rotation shaft. Opposite ends of the rotation shaft 90 are rotatably supported on a pair of bearing stands 92 through ball bearings not shown. The rotation shaft 90 has six sets of equidistant supporting arms 94. Each supporting arm set includes four supporting arms 94 projecting radially outwardly from the rotation shaft 90 at equal angular intervals, i.e., 90°. The supporting arms 94 are disposed so that they are axially aligned for forming four axial rows of supporting arms 94 as shown in FIG. 15. As best shown in FIG. 17, each supporting arm 94 includes a supporting pipe 96 fixed at its proximal end to the rotation shaft 90, a nut member 98 rotatably supported on the distal end of the supporting pipe 96 and a two-pronged hook member 100 threaded to the nut member 98. Each supporting pipe 96 has an inner circular flange 102 formed by bending its distal end radially inward. The inner circular flange 102 fits in a circular groove 104 formed in an associated rotatory nut member 98 for supporting the nut member 98. The two-pronged hook members 100 each have a stem portion 106 and a two-pronged hook portion 108 formed integrally with one end of the stem portion 106. The stem portion 106 of each hook member 100 is threaded with the nut member 98, and thus rotation of the nut member 98 axially moves the hook member 100 by preventing rotation of the latter.

Figure 16:
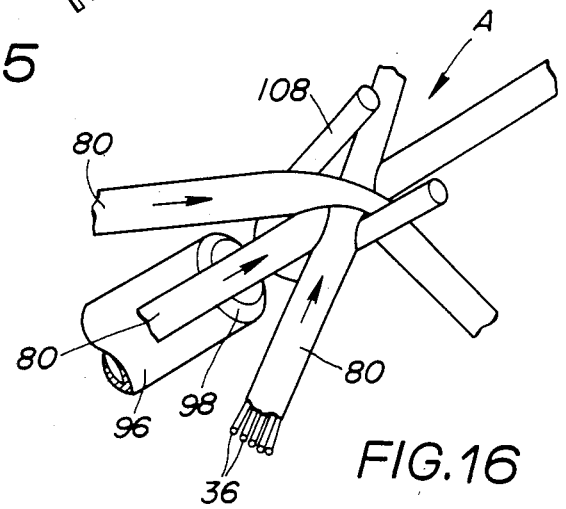
FIG. 16 is an enlarged partial view of the apparatus in FIG. 14 with the spiral elements and the longitudinal elements crossing each other.
Figure 18:
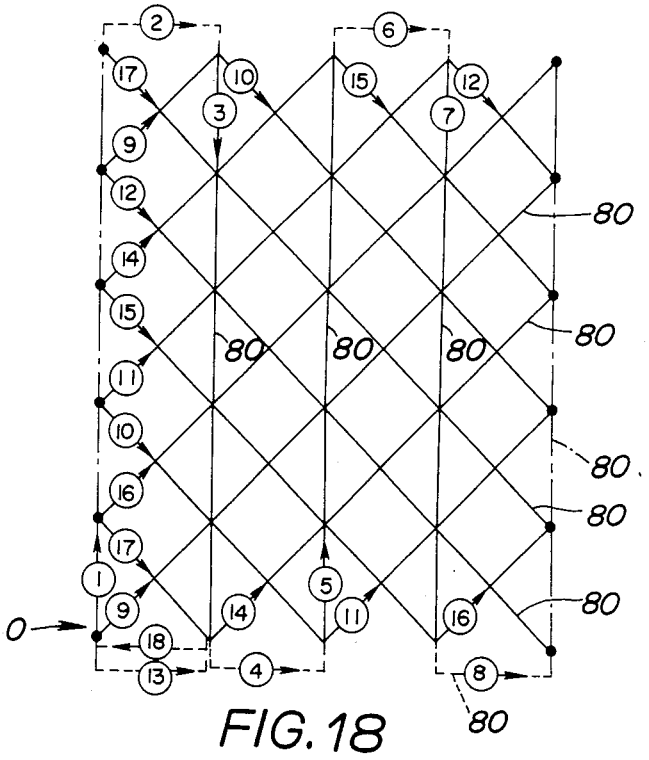
FIG. 18 is an illustration with a two-dimensional expansion as to how to interweave the spiral elements and the longitudinal elements.

In production, a row 80 of continuous resin-impregnated textile 36 is prepared by passing it through a bath of a resin, vinyl ester resin in this embodiment. Then, it is hooked under tension manually in hook portions 108 of hook members 100 of the supporting arms 94 in sequence to define the reinforcing unit 70. FIG. 18 illustrates a sequence of hooking the textile row 80 in development elevation, in which the two phantom lines indicate the same portion to form a longitudinal reinforcing element 72 and the arrows show the directions of passing of the textile row 80. The hooking of the textile row 80 starts from a supporting arm 94 which is for example one support arm, designated by O, of the leftmost support arm set in FIG. 14. The textile row 80 passes through the hooking portion 108 of each hooking member 100 in the numeric sequence given in FIG. 18 and then returns to its start point O. FIG. 16 illustrates a crossing portion A at this time. In this embodiment, this procedure is repeated four times. The textile row 80 thus extended must be kept tight until the impregnated resin is set. After setting of the resin, the portions of the continuous textile shown by the broken lines in FIG. 18 are cut, and then the nut member 98 of each supporting arm 94 is turned to retract the stem portion 106 of the two-pronged hook member 100 toward the supporting pipe 96 for separating the crossing portions A thus set from associated hook members 100. By this operation the concrete reinforcement unit 70 is removed from the apparatus shown in FIG. 14 and completed.

The process above stated may be achieved automatically by means of a conventional numerically controlled machine which is actuated on a predetermined program describing a three-dimensional pattern of the concrete reinforcing unit 70.

When the thickness of the longitudinal reinforcing elements 72 must be larger, an additional resin-impregnated textile row or rows are added to the portions to form them. The three-dimensional concrete reinforcing unit according to the present invention is not limited to a square tubular shape, but may be in the shape of a rectilinear tube, quadrangular pyramid, hollow cylinder, cone or other like configurations. The pitch of the crossing portions A of a longitudinal reinforcing element or elements 72 may be partially changed. Further, the reinforcing unit 70 may have an additional reinforcing element or elements such as a hoop.

EXAMPLE 1

Figure 19:
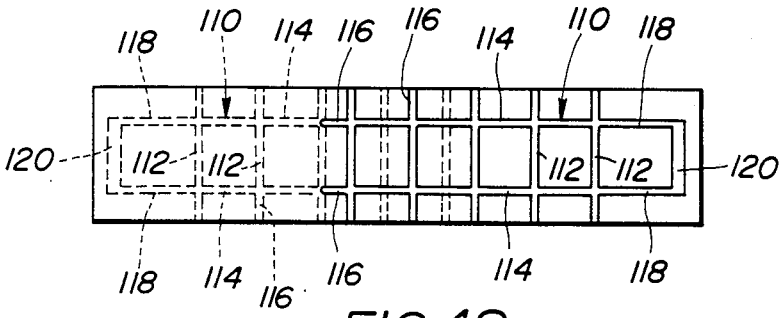
FIG. 19 is a plan view of a concrete panel used in Example 1, the upper grid shown by the solid lines for illustration purpose.
Figure 20:
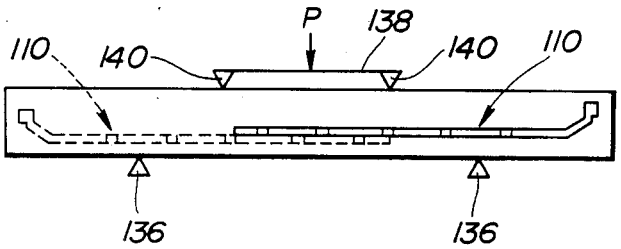
FIG. 20 is a side view of the concrete panel in FIG. 19.

A 200 mm×100 mm×1000 mm concrete panel which had a pair of glass fiber meshes 110 and 110 placed horizontally within it was prepared as illustrated in FIGS. 19 and 20, in which one mesh is shown by the solid line for illustration purposes. The pitch of each of the meshes was 100 mm, and the length and width thereof were 600 mm, and 200 mm, respectively. The projected portions 116 of crosswise elements 112 and longitudinal elements 114 of the meshes were 50 mm long. Although the outer ends 118 and 118 of the longitudinal elements 114 and 114 of each mesh were continuous via connecting element 120, it is believed that this resulted in no substantial influence on the experimental results. The two meshes were overlapped 150 mm at their inner end portions in contact with each other. The distance from the lower face of the lower mesh 110 to the bottom of the concrete panel was 20 mm.

Figure 22:
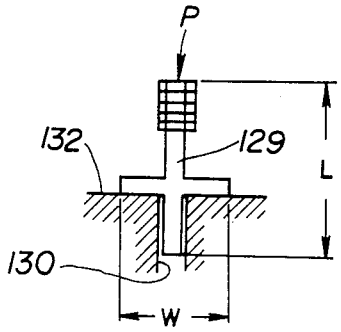
FIG. 22 is a front view of a test piece of Example 1 placed in a test machine.

Each of the glass fiber meshes 110 and 110 has substantially the same cross-sectional structure even in crossing portions thereof as the grid member 30 shown in FIGS. 1 to 3. That is, each of both crosswise elements 112 and the longitudinal elements 114 of the meshes had vertically stacked eight rows of glass fiber rovings bonded with a vinyl ester resin, each row consisting of four rovings. The vinyl ester resin was sold by Nippon (Japan) Upica, Japan under the trade designation "8250". Both the lengthwise and crosswise elements had substantially equal cross-sectional areas of about 10 mm×10 mm. Each roving consisted of about 2,100 glass fiber filaments, each of which had a diameter about 23 micrometers, a density of 2.55 g/cm$^3$ and denier of 19,980. Properties of the lengthwise and crosswise elements of the glass fiber meshes are given in TABLE 1. The average tensile strength of these elements was determined by stretching 200 mm long test pieces with their opposite end portions 50 mm long, cramped through a glass fiber roving cloth with chucks. The average strength of the crossing portions of the grid was determined by the use of cross-shaped test pieces 129 cut from the grid, as shown in FIG. 22, having a width 80 mm and a length 90 mm. Each test piece was fitted at its one longitudinal leg 30 mm long into a hole 130 formed in a base 132 of a test machine. Static loads were vertically applied to the upper end of the other longitudinal leg 50 mm long. The strength of the crossing portions is defined as a shear fracture load of the crosswise legs/the effective cross-sectional area of the legs. The results are also given in Table 1. The properties of the concrete used are set forth in Table 2.

The concrete panel thus prepared was cured and then placed on a pair of parallel supporting rods 136 and 136 for determining its load-strain behavior so that each rod 136 was located 280 mm away from the center of the panel. Then, a depressing plate 138 having a pair of parallel depressing rods 140 and 140 welded at its bottom face 280 mm away from each other was placed on the upper face of the concrete panel so that each depressing rod 140 was located 140 mm away from the center of the panel. Thereafter, static loads were applied to the depressing plate 138, and the results are plotted with the solid line in FIG. 23. It was noted that longitudinal elements 114 were fractured at the point P1.

EXAMPLE 2

Another concrete panel having a pair of carbon fiber grids placed within it was prepared and cured. The shape and size of the concrete panel and the grids were substantially the same as those in Example 1, and the carbon fiber grids were disposed in the concrete panel also in the same manner as in FIGS. 19 and 20.

The cross-sectional structure of each of the lengthwise and crosswise elements was substantially the same as that of each of the lengthwise and crosswise elements in Example 1 even in crossing portions except that each row of carbon fiber rovings included five rovings, each containing 10,000 carbon monofilaments having about 8 micrometers diameter. The carbon fiber roving elements were bonded with the same vinyl ester resin as in Example 1. The properties of the elements of the grid were determined by the same procedures in Example 1, and the results are given in Table 1. The carbon grid reinforced concrete panel underwent the same load-strain test as in Example 1, and the results are plotted with the broken line in FIG. 23. It was noted that longitudinal elements were fractured at the point P2.

COMPARATIVE TEST

Figure 21:
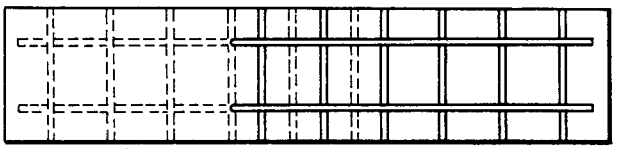
FIG. 21 is a plan view of another concrete panel used in Comparative Test, the upper grid shown by the solid lines for illustration purposes.

A steel grid reinforced concrete panel was prepared as illustrated in FIG. 21 and had the same size and structure as in Example 1 except that the longitudinal outer end portions of lengthwise elements of each grid were straight and not jointed together, and that the lengthwise and crosswise elements had a diameter 9.53 mm.

Figure 23:
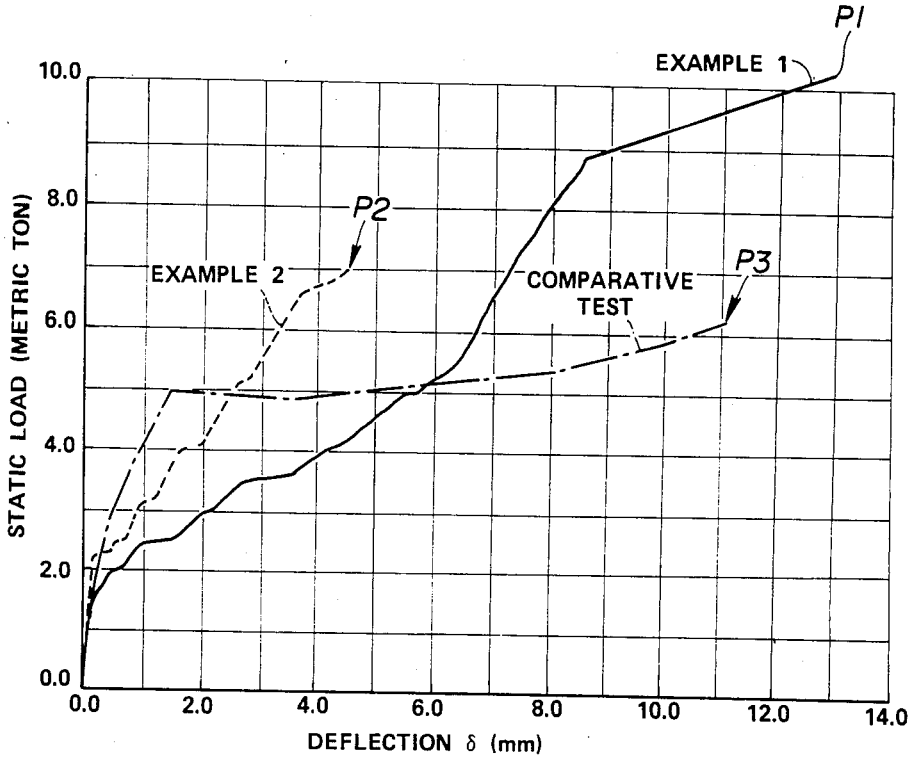
FIG. 23 is a graph showing results of static load tests.

The steel grid reinforced concrete panel was subjected to the same load-strain test as in Example 1, and the results are plotted with the phantom line in FIG. 23. It was noted that welded points of the crossing portions of the lengthwise and crosswise elements were fractured at the point P3.

TABLE 1

| | (average values given) | | |
|---|---|---|---|
| | Example | | Comparative |
| | 1 | 2 | Test 1 |
| Effective Cross-sectional area (mm$^2$) | 70.8 | 88.4 | 71.3 |
| Content of fiber in grid (volume %) | 39.4 | 22.6 | — |
| Tensile strength (kg/mm$^2$) | 72.1 | 38.1 | 57.0 |
| Young's modulus (kg/mm$^2$) | 2800 | 7400 | 19000 |
| Strength of crossing portions (kg/mm$^2$) | 26.1 | 16.3 | 15.8 |

TABLE 2

| Compressive Strength (Kg/cm$^2$) | Young's Modulus (ton/cm$^2$) | Poisson Ratio | Fracture Strength (Kg/cm$^2$) |
|---|---|---|---|
| 272–310 | 255–285 | 0.16–0.18 | 27–34 |

What is claimed is:

1. A concrete reinforcing unit adapted to be embedded in concrete for concrete construction, said concrete reinforcing unit comprising:

(a) first parallel reinforcement elements;

(b) second parallel reinforcement elements crossing said first parallel reinforcement elements at first crossing portions, each of said first reinforcement elements and said second reinforcement elements including at least one row of first textiles and a first resin matrix, made of a first resin, for bonding said first textiles thereof; and (c) attaching means for attaching said first reinforcement elements and said second reinforcement elements at corresponding first crossing portions to form a grid member having a peripheral portion, said attaching means comprising said first resin, said first and second reinforcing elements being impregnated with said first resin before attachment thereof.

2. A concrete reinforcing unit as recited in claim 1, wherein:

(a) at least one of said first reinforcing elements and said second reinforcing elements comprises a plurality of textile rows;

(b) the textile rows of both a corresponding first reinforcement element and a corresponding second reinforcement element are alternately stacked at the first crossing portion; and (c) said first reinforcing elements and said second reinforcing elements are bonded with said first resin at the first crossing portions.

3. A concrete reinforcing unit as recited in claim 2, wherein said first reinforcing elements and said second reinforcing elements have a substantially rectangular cross-section.

4. A concrete reinforcing unit as recited in claim 3, wherein:

(a) said grid member is substantially two-dimensional and (b) said grid member is embedded in the concrete so that said grid member is parallel with a surface of the concrete.

5. A concrete reinforcing unit as recited in claim 4, wherein:

(a) said grid member is used in the number of at least two and (b) adjacent grid members are disposed to overlap each other at the peripheral portions thereof.

6. A concrete reinforcing unit as recited in claim 1, 2, 3, 4 or 5, wherein:

(a) said first textiles are each formed in at least one structure of a tow, roving, strand, yarn, thread, sennit, twisted cord, and braid, and (b) said first textiles are made of at least one fiber selected from the group consisting of a glass fiber, carbon fiber, aramid fiber, boron fiber, ceramic fiber, and metallic fiber.

7. A concrete reinforcing unit as recited in claim 6, wherein said first resin matrixes are each made of at least one substance selected from the group consisting of an epoxy resin, unsaturated polyester resin, vinyl ester resin, polyurethane resin, diallyphthalate resin, phenolic resin, polyacetal resin, saturated polyester resin, polyamide resin, polystyrene resin, polycarbonate resin, polyvinyl chloride resin, polyethylene resin, polypropylene resin and acrylic resin.

8. A concrete reinforcing unit as recited in claim 7, wherein said first reinforcing elements and said second reinforcing elements each contains about 10 to about 90% by volume of said first textiles and about 90 to about 10% by volume of said first resin.

9. A concrete reinforcing unit as recited in claim 8, wherein said first reinforcing elements and said second reinforcing elements each contains about 30 to about 70% by volume of a glass fiber and about 70 to about 30% by volume of a vinyl ester resin.

10. A concrete reinforcing unit as recited in claim 8, wherein said first reinforcing elements and second reinforcing elements each contains about 20 to 60% by volume of a carbon fiber and about 80 to about 40% by volume of a vinyl ester resin.

11. A concrete reinforcing unit as recited in claim 1, 2, 3 or 4, and further comprising:

(a) at least three longitudinal parallel reinforcing elements disposed in a three-dimensional manner and (b) second attaching means for attaching said longitudinal parallel reinforcing elements to said first reinforcing elements and said second reinforcing elements, (c) wherein said first reinforcing elements and said second reinforcing elements cross corresponding longitudinal reinforcing elements at second crossing portions and are attached to the corresponding longitudinal reinforcements at the second crossing portions with said second attaching means.

12. A concrete reinforcing unit as recited in claim 11, wherein said longitudinal reinforcing elements each comprises:

(a) at least one row of second parallel textiles and (b) a second resin matrix, made of a second resin, for bonding integrally said row of said second textiles, wherein:

(c) the textile rows of each of a corresponding first reinforcing element, a corresponding second reinforcing element, and a corresponding longitudinal reinforcing element are alternately stacked at each of said second crossing portions and (d) said second attaching means is one of said first resin and said second resin.

13. A concrete reinforcing unit as recited in claim 12, wherein said first reinforcing elements and said second reinforcing elements extend between adjacent two longitudinal reinforcing elements so that said first reinforcing elements and said second reinforcing elements each define generally a spiral in an overall shape thereof.

14. A concrete reinforcing unit as recited in claim 12, wherein:

(a) said first textiles and said second textiles are each formed in at least one structure of a tow, roving, strand, yarn, thread, sennit, twisted cord, and braid, and (b) said first textiles and said second textiles are each made of at least one fiber selected from the group consisting of a glass fiber, carbon fiber, aramid fiber, boron fiber, ceramic fiber, and metallic fiber.

15. A concrete reinforcing unit as recited in claim 14, wherein said first resin matrixes and said second resin matrixes are each made of a substance selected from the group consisting of an epoxy resin, unsaturated ployester resin, vinyl ester resin, polyurethane resin, diallylphthalate resin, phenolic resin, polyacetal resin, saturated polyester resin, polyamide resin, polystyrene resin, polycarbonate resin, polyvinyl chloride resin, polyethylene resin, polypropylene resin and acrylic resin.

16. A concrete reinforcing unit as recited in claim 15, wherein:

(a) said first reinforcing elements and said second reinforcing elements each contains about 10 to about 90% by volume of said first textiles and about 90 to about 10% volume of said first resin, and (b) said longitudinal reinforcing elements each contains about 10 to about 90% by volume of said second textiles and about 90 to about 10% by volume of said second resin.

17. A concrete reinforcing unit as recited in claim 16, wherein said first reinforcing elements, said second reinforcing elements and said longitudinal reinforcing elements each contains about 30 to about 70% by volume of a glass fiber and about 70 to about 30% by volume of a vinyl ester resin.

18. A concrete reinforcing unit as recited in claim 17, wherein said first reinforcing elements, said second reinforcing elements, and said longitudinal reinforcing elements each contains about 20 to 60% by volume of a carbon fiber and about 80 to about 40% by volume of a vinyl ester resin.

* * * * *